United States Patent [19]

Froelich

[11] Patent Number: 4,543,750

[45] Date of Patent: Oct. 1, 1985

[54] APPARATUS FOR REFINISHING A PELLETIZING DIE

[76] Inventor: Leo Froelich, Box 67, Thief River Falls, Minn. 56701

[21] Appl. No.: 632,627

[22] Filed: Jul. 19, 1984

[51] Int. Cl.[4] ..... B24B 19/14

[52] U.S. Cl. ..... 51/50 R; 51/105 R

[58] Field of Search ..... 51/50 R, 105 R

[56] References Cited

U.S. PATENT DOCUMENTS

| | | | |
|---|---|---|---|
| 1,211,381 | 1/1917 | Alden | 51/105 R |
| 1,493,394 | 5/1924 | Leon | 51/105 R X |
| 2,142,710 | 1/1939 | Bigelow | 51/50 R |
| 2,284,134 | 5/1942 | Connor | 51/50 R X |
| 2,365,068 | 12/1944 | Gerbig | 51/50 R X |
| 2,367,069 | 1/1945 | Styberg | 51/105 R |
| 2,367,137 | 1/1945 | Olsson | 51/50 R |
| 2,498,012 | 2/1950 | Sjostrand | 51/50 R X |
| 2,587,952 | 3/1952 | Appleby | 51/105 R |
| 2,836,936 | 6/1958 | Lovely | 51/50 R |
| 3,187,470 | 6/1965 | Arneson | 51/105 R X |
| 4,417,422 | 11/1983 | Redeker et al. | 51/50 R |

*Primary Examiner*—J. Howard Flint, Jr.

*Attorney, Agent, or Firm*—Merchant, Gould, Smith, Edell, Welter & Schmidt

[57] ABSTRACT

An apparatus for refinishing a pellet-making die includes a revolvable turntable upon which the pellet-making die is positioned. A vertically shiftable grinder mechanism having a grinder stone engages the inner surface of the die and makes successive vertical strokes across the surface to be refinished. An acme threaded screw actuator controls the depth of cut made by the grinder mechanism.

5 Claims, 5 Drawing Figures

APPARATUS FOR REFINISHING A PELLETIZING DIE

This invention relates to an apparatus for dressing and refinishing the working surface of a pelletizing die.

SUMMARY OF THE INVENTION

Various types and sizes of dies are used in pellet-making mills to form the pellets, such as animal food pellets and the like. Typically, the pellet-making dies are of cylindrical configuration having openings through the cylindrical wall thereof. In the pellet-making process, material is introduced into the interior of the pellet-making die and is extruded outwardly through the openings therein.

Continued use of the die causes wear of the inner cylindrical working surface thereof. Specifically, edges defining the openings in the inner surface become eroded and lose their original symmetry. Further, the inner die surface wears more at its center portion so that in axial section the inner surface of a die assumes a concave configuration. These wear characteristics of the die make the die less efficient in the pellet-making process.

In order to refinish the inner working surface of the die, the mill operator usually sends the worn die to a machine shop where the die is dressed and refinished on a high precision lathe. This is an expensive and time-consuming operation and requires the die to be unavailable for a substantial period of time. In some instances, the mill operator will discard a worn die. Since dies are expensive, discarding worn dies also is costly. Applicant knows of no on-site die refinishing tool which permits refinishing of a pelletizing die by the mill operator.

It is a general object of this invention to provide a novel pelletizing die refinishing apparatus which permits onsite refinishing of the die by a user.

Another object of this invention is to provide a novel pelletizing die refinishing apparatus which allows the user to timely and effectively refinish the die to maintain the pellet-making die in a high production condition and to thereby extend the life of the die.

These and other objects of the invention are defined in the following description of the preferred embodiment.

FIGURES OF THE DRAWING

DESCRIPTION OF THE PREFERRED EMBODIMENT

Figure 1:
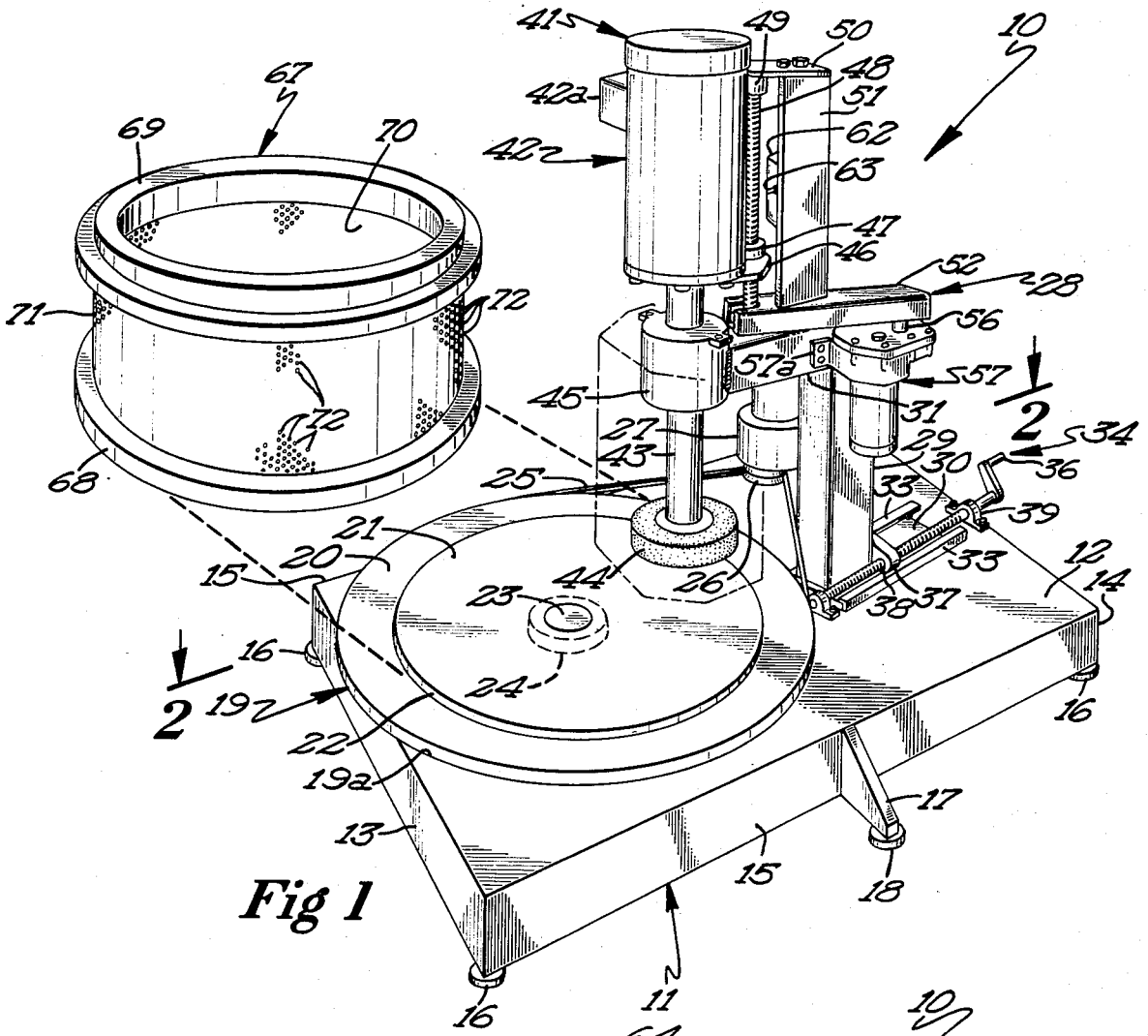
FIG. 1 is a perspective view of the novel die refinishing apparatus.
Figure 2:
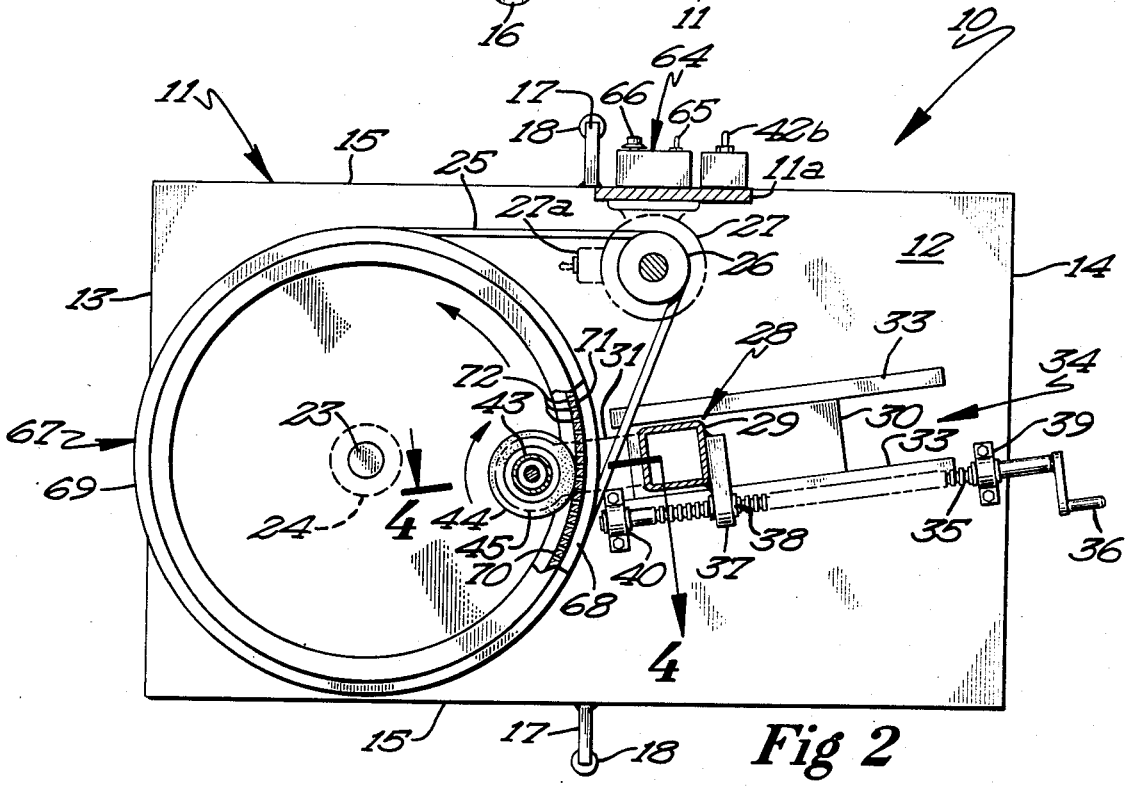
FIG. 2 is a cross-sectional view taken approximately along the line 2—2 of FIG. 1 and looking in the direction of the arrows.
Figure 3:
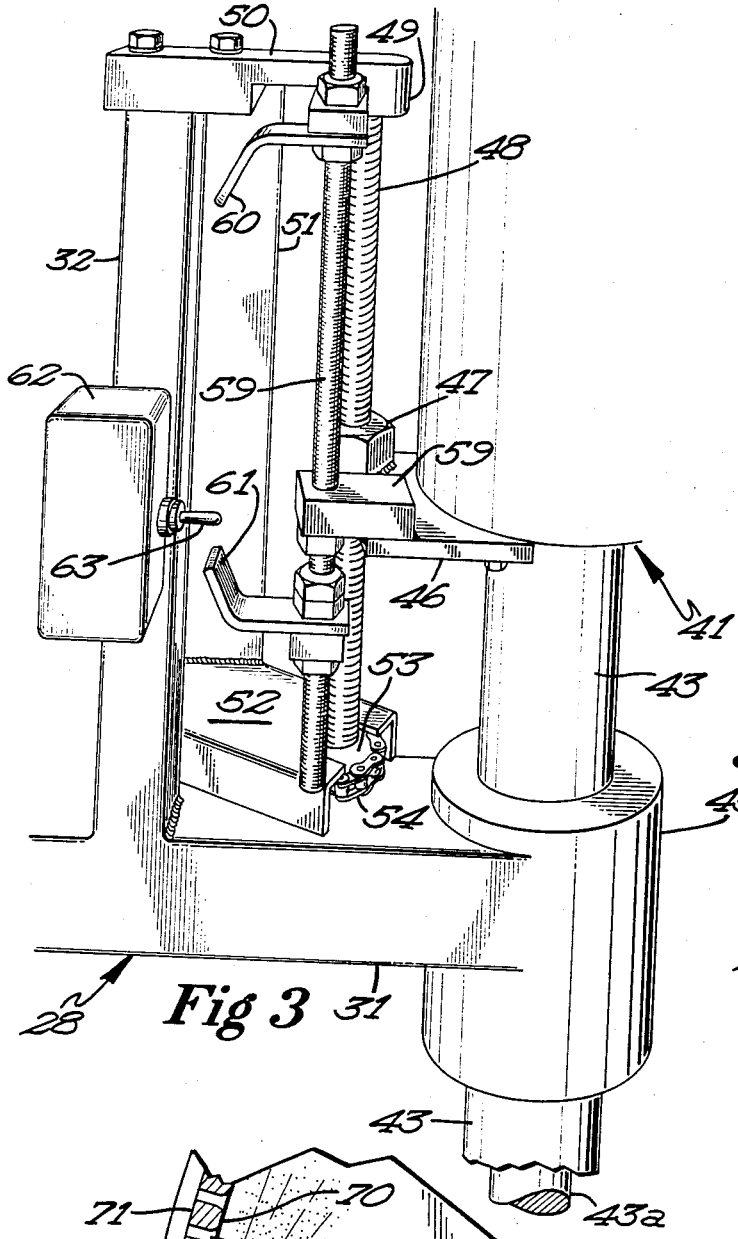
FIG. 3 is a fragmentary perspective view of a portion of the die refinishing apparatus.

Referring now to the drawings and more specifically to FIG. 1, it will be seen that one embodiment of the novel apparatus for refinishing pelletizing dies, designated generally by the reference numeral 10, is thereshown. The pelletizing die to be refinished is designated generally by the reference numeral 67 and will be described more fully hereinbelow. The die refinishing apparatus 10 includes a generally rectangular shaped base 11 having a flat, generally rectangular shaped top wall 12, a vertical front wall 13, a vertical rear wall 14, and opposed substantially parallel vertical side walls 15. Suitable foot pads 16 are provided at the corners defined between the side walls and the respective front and rear walls. A pair of legs 17 are each affixed to one of the side walls 15 intermediate the ends thereof and projecting outwardly therefrom. Each leg 17 is provided with a foot pad 18. The base 11 also has a vertical mounting plate **11*a*** secured to one of the side walls adjacent the rear end portion thereof.

The die refinishing apparatus 10 also includes a circular turntable 19 which is revolvably mounted on the base 11 and which has a substantially flat upper surface 20. However, the upper surface of the turntable has a centrally located embossed or raised central circular portion 21 which defines an annular shoulder 22. The annular shoulder 22 is concentrically arranged with respect to the outer edge **19*a* of the turntable. It will be noted that the outer edge 19*a*** of the turntable is of concave configuration.

The turntable 19 is provided with a depending stub shaft 23, which is revolvable in a bearing assembly 24. An endless drive belt 25 engages the concave outer edge **19*a* of the turntable and is also trained about a pulley 26 mounted on the output shaft of an electric motor 27. The electric motor 27 is mounted on the vertical plate 11*a* of the base 11. The electric motor 27 is provided with a control switch 27*a* which is also mounted on the mounting plate 11*a*. It will be seen that when the motor 27 is energized, the turntable 19 will be rotated about a vertical axis defined by the stub shaft 23. The motor 27 is provided with a control switch 27*a***.

The die refinishing apparatus 10 also includes a shiftable pedestal 28 which is mounted on the base and includes a vertically disposed lower pedestal member 29 having a substantially flat generally rectangular shaped base plate 30 affixed to the lower end thereof. The pedestal also includes an elongate horizontally disposed intermediate pedestal member 31 having one end thereof rigidly affixed to the upper end of the lower pedestal member 29. An elongate vertically disposed upper pedestal member 32 is affixed to the other end portion of the intermediate pedestal member 31 and extends upwardly therefrom. A pair of laterally spaced apart angle shaped elongate tracks 33 are rigidly affixed to the upper surface of the top wall 12 of the base 11 and are engaged by the base plate 30 to guide the pedestal in its horizontal rectilinear path of movement towards and away from the turntable 19.

Means are provided for shifting the pedestal 28 towards and away from the turntable 19 and this means 34 for shifting the pedestal comprises an elongate horizontally disposed acme threaded actuator screw 35 revolvably journaled in a rear bearing 39 and a front bearing 40, the bearings being mounted on the upper surface of the top wall 12. The threaded member 35 is provided with a crank handle 36 at one end thereof to facilitate the revolving movement of the threaded member. The lower pedestal member 29 has a horizontally disposed rigid bar 37 affixed thereto adjacent the lower end thereof and the bar 37 has a threaded opening 38 therethrough which is threadedly engaged by the threaded member 35. It will be seen that when the threaded member 35 is rotated, the bar 37 coacts with the threaded member and causes the pedestal 38 to be moved rectilinear towards or away from the turntable 19.

The die refinishing apparatus 10 includes a grinder mechanism 41 which is comprised of a heavy-duty electric motor 42 having a junction box 42*a* mounted thereon. The grinder mechanism includes arbor 43 secured to the motor housing and projecting downwardly therefrom. The output shaft 43*a* of the electric motor extends through the arbor and is journaled in a bearing 43*b* mounted at the lower end of the arbor. A horizontally disposed circular grinding stone 44 is removably mounted on the lower end of the output shaft 43*a* and is formed of a suitable abrasive material for refinishing the pelletizing die 67. The arbor 43 is vertically slidable in a sleeve bearing 45 affixed to the outer end of the intermediate pedestal member 31. It will therefore be seen that when the electric motor 42 of the grinder mechanism 41 is energized, the circular grinding stone will be rotated.

The electric motor 42 for the grinder mechanism 41 has a bracket 46 secured to the lower end thereof and the bracket 46 has a nut 47 secured thereto. The nut 47 is threadedly engaged by a vertically disposed acme threaded drive screw 48. The upper end of the drive screw 48 is journaled in a bearing 49 carried by a horizontally disposed plate 50. The plate 50 is rigidly affixed to the upper end of a vertical guard plate 51, which forms a suitable shield for the drive screw 48. The lower end of the vertical guide plate 51 is rigidly affixed to the upper surface of an elongate shield 52 which has one end thereof rigidly secured to the upper surface of the horizontally disposed intermediate pedestal member 31.

The lower end portion of the screw 48 has a sprocket 53 affixed thereto for rotation therewith. The lower end of the screw 48 is journaled in a suitable bearing. A drive chain 54 is trained about the sprocket 53 and about a sprocket 55 secured to the output shaft 56 of an electric motor gear box unit 57. The electric motor gear box unit 57 is mounted on the horizontally disposed intermediate pedestal member by a suitable bracket 57*a*. It will be seen that when the electric motor gear box unit 57 is energized, the drive screw 48 will be revolved thereby causing the nut 47 to move axially therealong. In this regard, it is pointed out that the electric motor gear box unit 57 is reversible so that when the motor is driven in one direction, the drive screw 48 will be rotated to move the grinder mechanism upwardly relative to the turntable and to the pedestal. Conversely, when the motor 57 is driven in the opposite direction, the grinder mechanism will move downwardly.

The bracket 46 secured to the nut 47 also has a bracket plate 58 affixed thereto projecting outwardly therefrom. The bracket plate 58 has a vertically disposed actuator rod 59 affixed thereto, and the actuator rod has an upper switch actuator element 60 secured thereto and projecting outwardly therefrom. The actuator rod 59 also has a lower switch actuator element 61 secured to the lower end portion thereof projecting outwardly therefrom.

A three position control switch 62 is mounted on the plate 11*a* and has a double throw switch arm 63 projecting outwardly therefrom. The switch arm 63 is positioned in obstructing relation with respect to the actuator element 60 and the actuator element 61. It will be seen that vertical movement of the grinder mechanism causes vertical movement of the actuator rod 59 so that either the upper switch actuator element or the lower switch actuator element will engage the switch arm 63. In this regard, if the grinder mechanism is being moved downwardly, the upper actuator element 60 will engage the switch to shift the same from an on position to a neutral off position. Further downward movement of the grinder mechanism will stop at this point and an operator must then actuate the switch downwardly to produce upward movement of the grinder mechanism.

A control box assembly 64 is also mounted on the vertical mounting plate 11*a* of the base 11 and the control box assembly 64 is provided with a switch 65 which is shiftable between on and off positions for controlling operation of the electric motor gear box unit 57. The control box assembly 64 is also provided with a potentiometer 66 to variously adjust the speed of rotation of the motor gear box unit 57. The plate 11*a* is also provided with switch box 42*b* for controlling operation of the electric motor 42 of the grinder mechanism 41.

Referring again to FIG. 1, it will be seen that one type of pelletizing die, designated generally by the reference numeral 67, is thereshown. The pelletizing die 67 is of cylindrical configuration and has a lower end flange 68 and an upper end flange 69. The die also includes an inner working cylindrical surface 70 and an outer cylindrical surface 71. The cylindrical wall of the die has a plurality of openings 72 therethrough which are arranged throughout the cylindrical wall. It will be appreciated that in normal use, the material to be pelletized will be introduced into the interior of the die while the latter is being rotated and this material will be forced or extruded outwardly through the opening 72 to thereby form the pellets.

Figure 4:
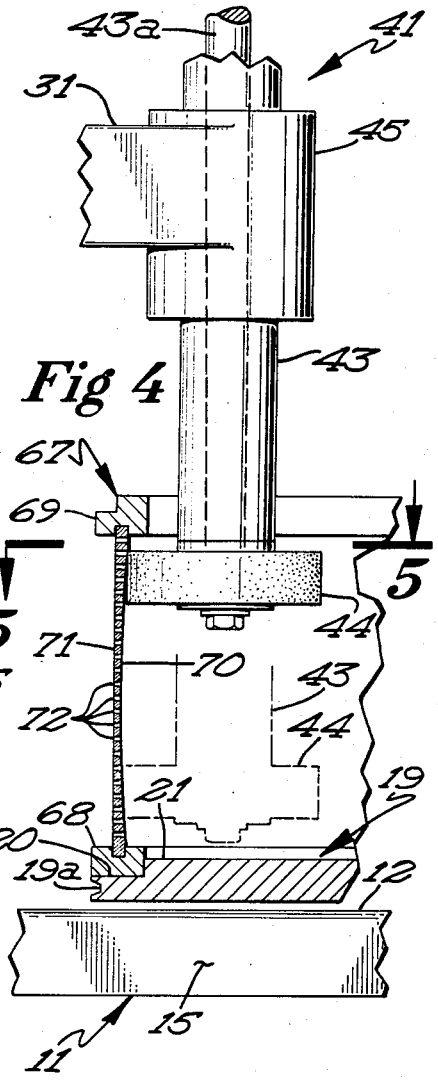
FIG. 4 is a cross-sectional view taken approximately along the line 4—4 of FIG. 2 and looking in the direction of the arrows.
Figure 5:
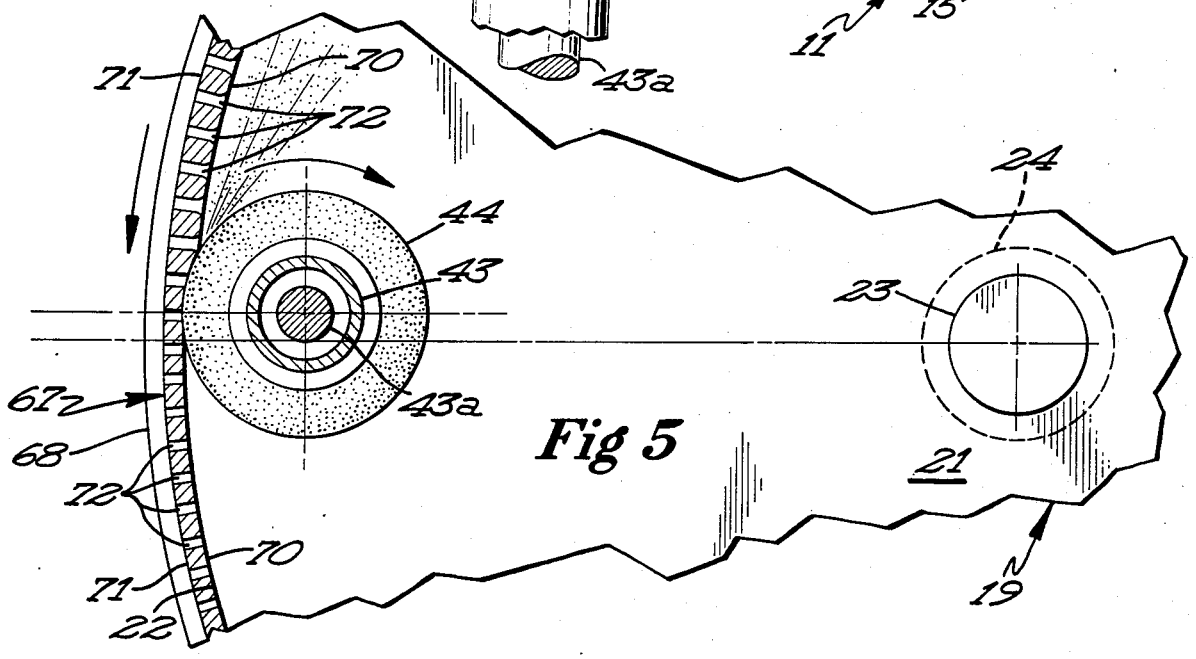
FIG. 5 is a cross-sectional view taken approximately along the line 5—5 of FIG. 4 and looking in the direction of the arrows.

In use, the pellet-making die 67 to be refinished will be placed upon the turntable 19 so that the inner cylindrical edge thereof engages the shoulder 22. Referring now to FIGS. 4 and 5, it will be seen that the inner surface of the die 67 adjacent and defining the opening 72 will be eroded from a surface defining sharp corners to curved corners. Further, the die is worn axially in the central portion thereof more than at the ends thereof. It will therefore be necessary to refinish the inner surface of the die so that the sharp corners are presented at the edges defining the openings 72 at the inner surface 70 of the die. Further, the refinishing will remove the concavity resulting from the wear of the central portion of the interior surface 70.

The grinder mechanism 41 will be actuated by closing the switch 42*b* so that the grinding stone will be positioned interiorly of the die and the actuator screw 35 will be adjusted so that the grinding stone 44 engages the inner surface. The switch 27*a* will be shifted to the on position to operate the turntable and the switch 65 will be closed to energize the motor gear unit 57. When this occurs, the turn-table will be revolved, as well as the grinding stone 44. It will be noted that the grinding stone 44 will be revolved in a direction oppositely to that of the turntable. The potentiometer 66 may be adjusted to control the rate of vertical movement of the grinder mechanism 41.

Assuming that the grinder mechanism is positioned so that the grinding stone 44 is at the end of the downward stroke, the switch arm 63 will be shifted to cause the grinder mechanism to move upwardly. The entire grinder mechanism will shift upwardly by the coaction of the drive screw 48 with the nut 47 until the switch actuator element 61 engages the switch arm 63 to shift the same to the neutral or off position. The grinder mechanism will continue to operate even though the grinder mechanism is not being shifted vertically relative to the die. The operator will then adjust the actuator screw 35 so that the grinding stone 44 will make a deeper cut and then shift the switch arm 63 so that the grinder mechanism will be moved downwardly. The inner surface of the die will be ground and refinished during each pass of the grinder mechanism through a vertical up or down stroke. Referring to FIG. 5, it will be noted that the center line of the path of rectilinear movement of the pedestal is offset relative to the axis of rotation of the turntable. This is necessary in order to avoid chattering of the grinding stone against the die during the grinding operation.

It has been found that a pellet-making die can be typically refinished in approximately 30 to 45 minutes through the use of the novel apparatus. It is pointed out that the desired speed of the vertical cut may be adjusted by the potentiometer 66. The depth of the cut may be readily adjusted by the operator by adjusting the actuator screw 35.

It is also pointed out that power means and drive means, other than electro-mechanical drive means, may be used to operate the various components. Further, the entire system may be connected to a microprocessor for complete automation.

One of the advantages of the present apparatus is that it may be retained at the mill site for refinishing a worn die. Thus, an operator may remove a worn die and replace the same with a refinished die while the worn die is being refinished at the mill location. By having a refinishing apparatus at the mill, the user may extend the life of the die and increase the hourly production by closer maintenance of the die than the methods heretofore practiced. This timely maintenance keeps the die cutting surfaces sharp and smooth for optimum efficiency.

From the foregoing description, it will be seen that I have provided a novel pelletizing die refinishing apparatus, which is not only of simple and inexpensive construction, but one which functions in a more efficient manner than any heretofore known comparable apparatus.

What is claimed is:

1. An apparatus for refinishing the inner cylindrical face of a cylindrical pellet-making die having a plurality of openings therethrough, comprising:

a support base, a turntable revolvably mounted on said base for rotation relative thereto, means operatively connected with said turntable for rotating the same about a vertical axis, said turntable supporting thereon a pellet-making die so that the axis of the die is vertically disposed, a vertically disposed pedestal mounted on said base and projecting upwardly therefrom and being horizontally movable relative thereto, means on said base operatively connected with said pedestal for shifting the latter in a rectilinear horizontal path of movement towards and away from said turntable, a power driven grinder mechanism mounted on said pedestal and being vertically shiftable relative thereto, said grinder mechanism including the horizontally oriented grinding stone revolvable about the vertical axis, means operatively connected with said grinding stone for revolving the same, means on said pedestal operatively connected with said grinder mechanism for shifting the same vertically in opposite directions whereby, when said grinding stone is disposed in engaging relation with the inner surface of the pellet-making die revolvably supported on said turntable and said grinder mechanism is alternately moved vertically in opposite directions, the inner surface of the die will be refinished.

2. The apparatus as defined in claim 1 wherein said means for shifting said pedestal horizontally comprises a horizontally disposed threaded actuator screw and means on said pedestal defining a nut threadedly engaging said actuator screw.

3. The apparatus as defined in claim 1 wherein said means for vertically shifting said grinder mechanism comprises a vertically disposed drive screw and a nut on said grinder mechanism threadedly engaging said vertical drive screw.

4. The apparatus as defined in claim 1 and means on said turntable for centering a die on said turntable.

5. The apparatus as defined in claim 1 wherein the center line of the path of rectilinear movement of the pedestal is offset with respect to the axis of rotation of said turntable.

* * * * *